US007828272B2

(12) United States Patent
Glover

(10) Patent No.: US 7,828,272 B2
(45) Date of Patent: Nov. 9, 2010

(54) CARBURETTOR

(75) Inventor: Stephen Brian Glover, Killarney (IE)

(73) Assignee: Ricardo UK Limited, West Sussex (GB)

( * ) Notice: Subject to any disclaimer, the term of this patent is extended or adjusted under 35 U.S.C. 154(b) by 379 days.

(21) Appl. No.: 11/547,933

(22) PCT Filed: Mar. 23, 2005

(86) PCT No.: PCT/GB2005/001098

§ 371 (c)(1),
(2), (4) Date: Aug. 20, 2008

(87) PCT Pub. No.: WO2005/098226

PCT Pub. Date: Oct. 20, 2005

(65) Prior Publication Data

US 2008/0303178 A1 Dec. 11, 2008

(30) Foreign Application Priority Data

Apr. 7, 2004 (GB) ..... 0407921.6

(51) Int. Cl.
*F02M 7/24* (2006.01)

(52) U.S. Cl. ..... 261/23.2; 123/73 PP; 261/23.3; 261/46; 261/DIG. 1

(58) Field of Classification Search ..... 261/23.2, 261/23.3, 46, 55, 63, DIG. 1; 123/73 PP
See application file for complete search history.

(56) References Cited

U.S. PATENT DOCUMENTS 7,011,298 B2 * 3/2006 Gerhardy et al. ..... 261/46

(Continued)

FOREIGN PATENT DOCUMENTS

DE 103 26 488 4/2004

(Continued)

*Primary Examiner*—Richard L Chiesa
(74) *Attorney, Agent, or Firm*—Cowan, Liebowitz & Latman

(57) ABSTRACT

The carburetor (1) includes a flow duct including rich (60) and lean (50) flow passage in parallel, through which, in use, air flows in a flow direction and which are separated by a substantially planar partition (30), at least one fuel jet 5 communicating with the rich passage (60), the partition (30) including an aperture (40) towards which the fuel jet (5) is directed, and a substantially planar butterfly valve (20) being received in the aperture (40) so as to be pivotable between a first position, in which the flow duct is substantially closed and the aperture (40) is substantially open, and a second position, in which the flow duct is substantially open and the aperture (40) is substantially closed, the upstream half of the aperture (40) being defined by an upstream semi-annular seating ledge (48) affording an upstream seating surface which is engaged by one of the surfaces of the butterfly valve (20) when it is in the second position and a first end surface which extends between the upstream seating surface and that surface of the partition (30) which is directed towards the lean passage (50), the downstream half of the aperture (40) being defined by a down-stream semi-annular seating ledge (49) affording a downstream seating surface which is engaged by the other surface of the butterfly valve (20) when it is in the second position and a second end surface, which extends between the downstream seating surface and that surface of the partition (30) which is directed towards the rich passage.

10 Claims, 4 Drawing Sheets

U.S. PATENT DOCUMENTS

| | | | | |
|---|---|---|---|---|
| 2004/0051186 | A1* | 3/2004 | Gerhardy et al. | 261/43 |
| 2005/0120985 | A1* | 6/2005 | Rosskamp | 123/73 PP |

FOREIGN PATENT DOCUMENTS

| | | |
|---|---|---|
| JP | 2001-295652 | 10/2001 |
| WO | 99/58829 | 11/1999 |
| WO | 02/092978 | 11/2002 |

* cited by examiner (a)

(b)

(c)

CARBURETTOR

CROSS-REFERENCE TO RELATED APPLICATIONS

This application claims priority to International Application No. PCT/GB2005/001098 filed Mar. 23, 2005, which is the national stage of Great Britain Application No. 0407921.6 filed Apr. 7, 2004, the entire disclosures of which are hereby incorporated by reference.

The present invention relates to carburettors of the type disclosed in WO99/58829. Such carburettors are intended for use with two stroke engines whose inlet duct is divided into two separate passages, referred to as a rich passage and a lean passage. The carburettor is arranged to direct a rich fuel/air mixture into the rich passage and a weak mixture or substantially pure air into the lean passage at high engine load, when the carburettor butterfly valve is substantially fully open, but to direct a substantially equally rich mixture into both the rich and lean passages at low engine load, when the butterfly valve is substantially closed.

The engine with which the carburettor is used is of the crankcase scavenged type and is arranged so that the combustion space is filled with a stratified charge, that is to say a charge whose fuel/air ratio varies over the volume of the combustion space, at high engine load but with a substantially homogeneous charge, that is to say a charge whose fuel/air ratio is substantially the same over the volume of the combustion space, at low engine load. This is achieved in the engine disclosed in WO99/58829 by dividing the interior of the crankcase into two or more separate volumes, one of which, referred to as the rich volume, communicates with the rich passage, and the other of which, referred to as the lean volume, communicates with the lean passage. The rich and lean volumes communicate with the combustion space at different positions.

Under high engine load, the combustion space is scavenged primarily with substantially pure air from the lean volume. The remaining pure air and the rich fuel/air mixture from the rich volume do not mix thoroughly and the charge is stratified. Under low load, there is a similar relatively weak fuel/air mixture in both the rich and lean volumes and the charge in the combustion space is therefore substantially homogeneous.

The carburettor disclosed in WO99/58829 is shown highly schematically here in FIG. 1. The carburettor 1 includes a flow duct comprising rich 60 and lean 50 flow passages in parallel, through which, in use, air flows in a flow direction and which are separated by a substantially planar partition 30, at least one fuel jet 5 communicating with the rich passage 60, the partition 30 including an aperture 40 towards which the fuel jet 5 is directed, and a substantially planar butterfly valve 20 being received in the aperture 40 so as to be pivotable between a first position, in which the flow duct is substantially closed and the aperture 40 is substantially open, and a second position, in which the flow duct is substantially open and the aperture 40 is substantially closed, the upstream half of the aperture 40 being defined by an upstream semi-annular seating ledge 48 affording an upstream seating surface which is engaged by one of the surfaces of the butterfly valve 20 when it is in the second position and a first end surface which extends between the upstream seating surface and that surface of the partition 30 which is directed towards the lean passage 50, the downstream half of the aperture 40 being defined by a downstream semi-annular seating ledge 49 affording a downstream seating surface which is engaged by the other surface of the butterfly valve 20 when it is in the second position and a second end surface, which extends between the downstream seating surface and that surface of the partition 30 which is directed towards the rich passage.

When the engine is idling, the butterfly valve 20 substantially blocks the flow passages 50, 60 and opens the aperture 40. Some of the fuel discharged from the jet 5 can flow through the aperture 40 and is therefore carried generally equally by the airflow into the passages 50 and 60.

In high load operation, the butterfly valve 20 does not block the flow passage but instead closes the aperture 40, ensuring that all the fuel sprayed from the jets 5 flows into the rich passage 60. Substantially pure air flows through the lean passage 50.

The problem with this carburettor is that at high load operation, when the butterfly valve 20 closes the aperture 40, some of the fuel exiting the jets 5 tends to leak through the seal created by closure of the aperture 40 by the valve 20, and escapes into the lean passage 50. This leakage results in a higher concentration of fuel being exhausted from the engine during the scavenging process, leading to higher emission levels than is desired.

In order to meet emissions legislation, it is highly desirable that fuel in the rich passage 60 does not leak into the lean passage 50. However, to use an additional seal such as a rubber seal would add cost and complexity to the manufacture of the carburettor.

It has been identified by the inventor of the present invention that the leakage from the rich passage 60 to the lean passage 50 is due to local pressure gradients across the edges of the valve 20. The internal geometry of the carburettor creates pockets of localised high and low pressure around the valve 20 and the pressure can be locally lower at the valve edge in the lean passage 50 than it is at the valve edge in the rich passage 60. Since gas flows from a high-pressure region to a low-pressure region, the air and fuel in the rich passage 60 tends to seep between the valve 20 and the partition wall 30 into the lean passage 50.

The present invention aims to reduce the likelihood of gas seepage from the rich passage into the lean passage in a simple and effective manner by altering the geometry of the carburettor to redress the pressure differentials across the valve edges, creating an air seal between the two passages. The terms "rich surface" and "lean surface" of the valve and partition are used to denote those surfaces directed towards the rich and lean passages, respectively.

According to the invention, a carburettor of the type referred to above is characterised in that a protrusion, preferably a bluff protrusion, is disposed adjacent the second end surface on the surface of the partition which is directed toward the lean passage, the protrusion having an upstream face that is positioned such that, in use in the second position of the valve, a stagnation pressure is generated thereon.

This feature may increase the pressure in the airflow in the lean passage over the downstream half of the butterfly valve. The protrusion causes a blockage in the flow path in the lean passage at the downstream side of the butterfly valve. Consequently, the pressure in the airflow increases as it approaches the protrusion, then stagnates against the protrusion. This creates a high-pressure region at the valve downstream edge in the lean passage, greatly reducing the chance of flow leakage from the rich passage channel into the lean passage.

The protrusion may protrude into the lean passage to at least the extent that a pivot rod upon which the butterfly valve is mounted protrudes into the lean passage.

The protrusion may comprise a first surface oriented substantially orthogonally to the partition and a second surface adjacent the first surface and disposed at an angle of less than 180 degrees, e.g. an angle of less than or equal to 90 degrees thereto, the first and second surfaces meeting at an edge which is substantially rounded.

The first surface may be inclined such that a portion thereof that protrudes furthest into the lean passage extends further into the aperture than does a portion of the surface that is nearer to the partition wall.

The rounded edge minimises the extent of flow separation from the edge. Such separation is not desirable as it can block the downstream part of the lean passage to the air flowing from upstream.

Alternatively or additionally, the carburettor may be characterised in that the upstream seating surface is dimensioned to engage substantially the entire upstream surface of the valve directed towards the lean passage when the valve is in the second position.

In practice, the upstream seating surface will be generally semi-circular and will engage the surface of the upstream half of the valve.

This feature increases the length of the potential leakage path on the upstream side of the valve and makes use of the high-pressure region that is present upstream of the pivot rod carrying the valve and protruding into the lean passage, caused by a stagnation pressure generated on the upstream side of the pivot rod. The flow pressure increases towards stagnation at the pivot rod.

The gap at the upstream edge of the valve is effectively displaced to the edge of the seating ledge as far as the airflow is concerned. Therefore, the stagnation pressure that is generated at the upstream side of the pivot rod has a much greater effect on the 'gap' than it would if the gap were further away from the pivot rod as is the case with the semi-annular upstream seating ledge of WO99/58829. The high-pressure region extends over the seating ledge upper surface and so creates high pressure at the gap between the seating surface and the valve surface directed towards the lean passage. This pressure is likely to be higher than that at the gap between the valve edge and the partition in the rich passage. This greatly reduces the likelihood of air in the rich passage leaking into the lean passage.

The valve may be mounted upon a pivot rod for rotation between said first and second positions, the pivot rod being constructed such that it protrudes into the lean passage only. The result is that when the valve closes the aperture, the rich passage is free of protuberances other than the downstream seating ledge.

Removing the presence of the pivot rod in the rich passage removes a blockage to the flow over the surface of the valve facing towards the rich passage, and removes the possibility of a stagnation pressure and its associated high pressure region upstream of the pivot rod being generated in the rich passage. Thus the pressure at the gap between the valve upstream edge and the partition is likely to be lower than it would be with the pivot rod being present in the rich passage, reducing the possibility of flow leakage from the rich passage into the lean passage.

Alternatively or additionally, the carburettor may be characterised in that the partition includes a semi-circular upstream face directed towards the aperture at the downstream portion thereof which is spaced from the side surface of the valve, when in the second position, whereby, in use, a stagnation pressure is generated on the upstream surface.

This feature reduces the possibility of gas leakage from the rich passage into the lean passage by increasing the local pressure at the valve edge in the lean passage.

The upstream face may be inclined toward the aperture such that a portion thereof that is closest to the lean passage extends further into the aperture then does another portion thereof that is closest to the seating surface.

The peripheral edge of the valve may be inclined at the same angle of inclination or a lesser angle of inclination and in the same direction as the inclination of the upstream face of the partition wall.

Alternatively or additionally, the carburettor may be characterised in that the partition wall and valve are arranged such that, in use, in the second position, the surface of the valve directed toward the rich passage and the surface of the planar partition upstream of the valve that is directed towards the rich passage are substantially aligned with one another.

The valve may comprise a second substantially planar plate disposed adjacent the rich surface thereof.

The provision of such a second plate effectively increases the valve thickness at the side of the valve directed toward the rich passage, in order to bring the valve rich surface into alignment with the face of the partition wall upstream of the valve.

Alternatively or additionally, the carburettor may be characterised in that the valve includes a resilient protrusion on the upstream surface thereof directed towards the lean passage and/or on the downstream surface thereof directed towards the rich passage, the protrusion being arranged for resilient sealing engagement with the respective seating surface.

The resilient protrusion may be a tongue inclined at an angle to the valve surface such that, in use, in the second position, the tongue is deformed against the associated seating surface to provide a mechanical seal therebetween.

The resilient protrusion may extend around substantially the whole valve upstream upper surface or downstream lower surface.

The resilient protrusion may be of inverted U-shaped cross-section and may be manufactured from rubber or from plastic. The resilient protrusion may be integral with the valve or a separate component.

Alternatively or additionally, the carburettor may be characterised in that the valve upstream surface directed towards the lean passage and/or downstream surface directed towards the rich passage is contoured to incorporate a protrusion, which, in use in the second position of the valve, provides a contact seal between the valve and the upstream or downstream seating ledge, respectively.

The valve may be stamped out from a suitable non-resilient material.

The present invention will now be explained in more detail in the following description of preferred embodiments with reference to the accompanying diagrammatic drawings, in which: —

FIG. 8 is a schematic view showing a further possible feature of the carburettor;

Figure 10:
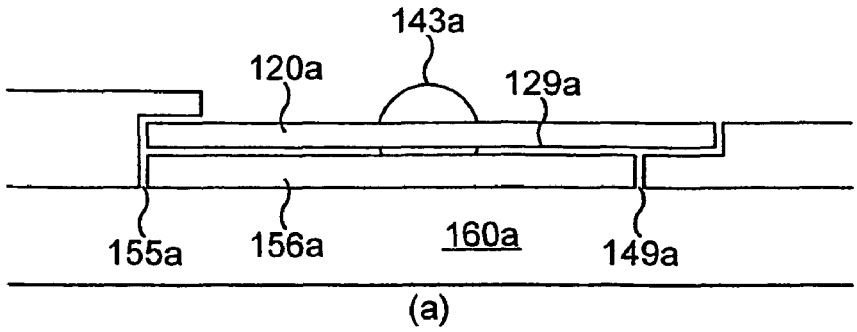
Figure 10:
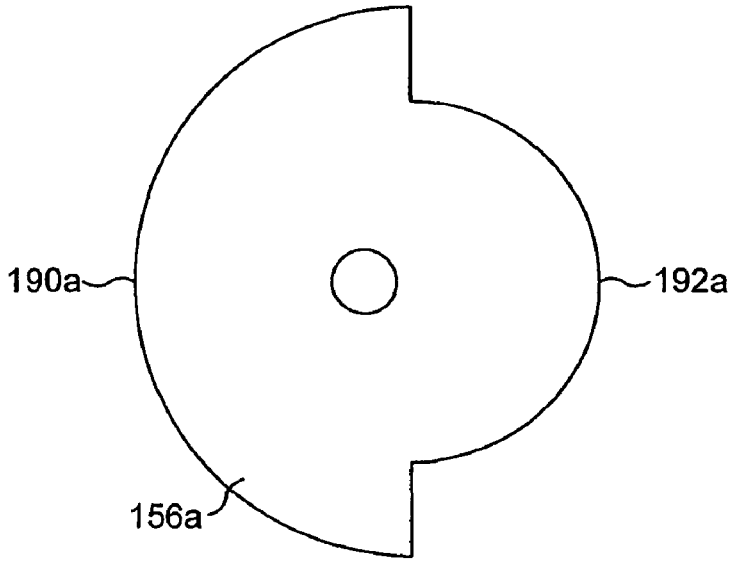
Figure 10:
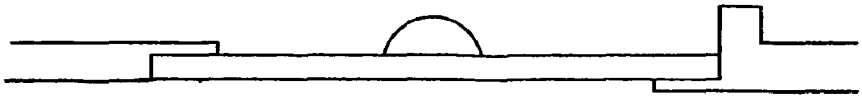

FIG. 9*a* and FIG. 9*b* are schematic views showing a further possible feature of the carburettor and a modification of it;

FIG. 10*a* is a schematic view showing yet a further possible feature of the carburettor;

FIG. 10*b* is a schematic plan view of the spacer plate of the embodiment of FIG. 10*a;*

FIG. 10*c* is a schematic view showing a modification of the embodiment of FIG. 10*a*.

Figure 1:
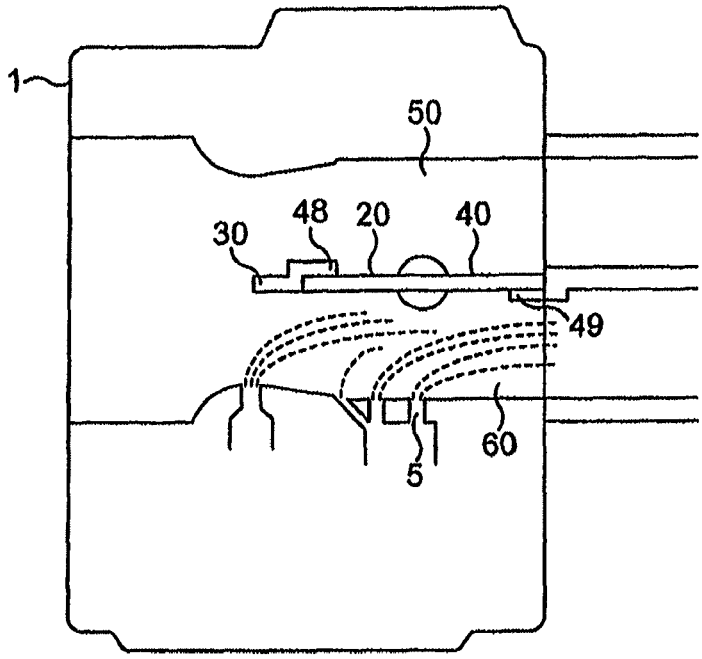
FIG. 1 Prior Art
FIG. 1 is a schematic view representing a carburettor according to the present invention.
Figure 2:
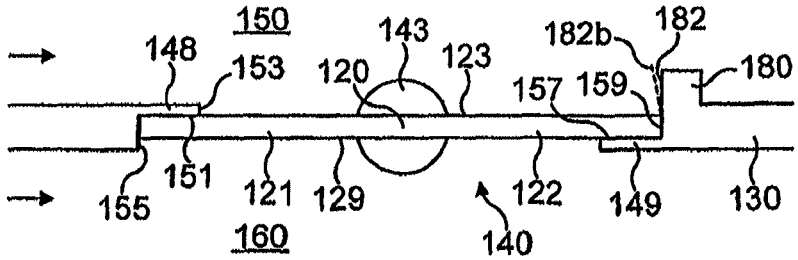
FIG. 2 is a view of a part of a carburettor according to the present invention.

The carburettor shown schematically in FIG. 2 is generally similar to that in FIG. 1, and identical parts have been numbered with the same reference number with the prefix '1'. Thus, FIG. 2 shows a partition wall 130 separating a rich passage 160 from a lean passage 150. An aperture 140 is formed within the partition wall 130, in which is received a butterfly valve 120 for selectively opening and closing the aperture 140 and simultaneously closing and opening the flow duct through the carburettor. The valve 120 comprises a substantially flat, circular disc with a lean surface 123, that is directed towards the lean passage 150, and a rich surface 129, that is directed towards the rich passage 160. The valve 120 has an upstream side 121 and a downstream side 122, the demarcation being the pivot rod 143 upon which the valve 120 is mounted. The pivot rod 143 comprises a circular rod that extends through the valve centreline in a direction perpendicular to the flow direction of the carburettor, as defined by the partition wall 130. The diameter of the pivot rod 143 is larger than the thickness of the valve disc 120, and so the pivot rod 143 protrudes from the valve 120 forming generally semi-cylindrical protuberances into the lean passage 150 and the rich passage 160. When the valve 120 is closed or partially closed, the rich passage 160 and lean passage 150 are substantially blocked to the oncoming flow, as the valve 120 throttles the flow through the carburettor. When the valve 120 is open, the rich passage 160 and lean passage 150 are unblocked to the oncoming flow. The arrows to the left of FIG. 2 designate the flow direction.

The aperture 140 is defined by seating ledges 148 and 149. The upstream half of the aperture 140 is defined by the upstream seating ledge 148, which comprises a semi-annular ledge or step of a thickness less than half of the thickness of the partition wall 130, integral with the partition wall 130. The upstream seating ledge 148 comprises a seating surface 151 directed towards the rich passage 160 and a first end surface 153 substantially orthogonal to the seating surface 151. The seating ledge 148 has a upstream face 155 that is curved with the same curvature as the valve 120 such that when the valve 120 fully closes the aperture 140, it is seated with a close fit against the upstream face 155 and seating surface 151. The fit between the valve 120 and the seating ledge 148 is very close in order to minimise seepage of gases around the valve edge from the rich passage 160 into the lean passage 150.

The upstream face 155 is shown in FIG. 2 to extend below the thickness of the valve for clarity of illustration only. In practice, it is preferable that the upstream face 155 extends only slightly beyond the thickness of the valve 120 and it is more preferable that it does not extend beyond the valve thickness, as shown in FIG. 10C. In this manner, the cross section of the rich passage 160 is maintained as constant as is practicable.

An alternative embodiment for maintaining a constant cross-section of the rich passage 160 is shown in FIG. 10*a* and FIG. 10*b*. In this embodiment, the cross-section is maintained substantially constant across the whole length of the valve 120*a* and also immediately upstream and downstream thereof.

The upstream face 155*a* of the partition wall 130*a* extends beyond the valve 120*a* a small distance. The distance is made up using a spacer plate 156*a*. The spacer plate 156*a* is a thin plate that is fastened to the rich surface 129*a* of the valve 120*a* using a countersunk screw (not shown) that is also used to fasten the valve 120*a* to the pivot rod 143*a*. The spacer plate 156*a* is shaped as shown in FIG. 10*b*; an upstream edge 190*a* thereof is semi-circular and has the same radius as the valve 120*a*. When assembled on the pivot rod, the upstream edges of the valve 120*a* and of the spacer plate 156*a* are therefore substantially flush with one another. A downstream edge 192*a* of the spacer plate 156*a* is also semi-circular but of a smaller radius than the upstream radius 190*a*, such that it fits closely adjacent the downstream seating ledge 149*a* when the valve 120*a* is in the second position.

Reverting now to FIG. 2, the downstream half of the aperture 140 is defined by the downstream seating ledge 149, which also comprises a semi-annular ledge of approximately half the thickness of the partition wall 130. The seating ledge 149 is almost identical to the upstream seating ledge 148 and when the valve 120 fully closes the aperture 140, it is seated against seating surface 157, which is directed towards the lean passage 150, and a downstream face 159 that is curved with the same curvature as the valve 120. The downstream face 159 is contiguous with an upstream face 182 of a semi-annular or part-annular protrusion 180. The protrusion 180 shown in FIG. 2 has a rectangular cross-section and extends perpendicularly from the partition wall 130 into the lean passage 150. The pivot rod 143 has a circular cross-section and as such, the portion of the pivot rod 143 protruding into the lean passage 150 has a height of approximately half its diameter. The protrusion 180 protrudes from the partition wall 130 to an extent beyond the protrusion of the pivot rod 143 into the lean passage 150. Although the protrusion need protrude into the lean passage 150 only to the extent that it generates the required stagnation pressure on its upstream face, in practice it should preferably have a height of not less than the half diameter of the pivot rod 143 that protrudes into the lean passage 150. In practice, the diameter of the pivot rod 143 will be as small as is practicable, whilst the height of the protrusion 180 is preferably as large or larger than half the diameter of the pivot rod 143 that protrudes into the lean passage 150.

The rectangular cross section of the protrusion is a bluff shape and is easily manufactured. The upstream edge of the protrusion is rounded. The upstream face 182 of the protrusion 180 as shown in FIG. 2 is substantially orthogonal to the partition wall 130. Alternatively, the upstream face 182, and face 159 of the seating ledge 149, may be inclined slightly as shown by dotted line 182*b* in FIG. 2. In this case, the circumferential face of the valve 120 is also inclined at the same angle or a lesser angle of inclination. A sufficient clearance gap is required between the valve peripheral edge and the downstream face 159 such that the valve 120 is able to rotate in and out of register with the seating ledge 149.

In use, when the valve 120 fully closes the aperture 140, the flow in the lean passage 150 close to the lean surface 123 of the valve 120 slows down as it approaches the upstream face 182 of the protrusion 180, slowing to a stop at the upstream face 182. The pressure accordingly increases, increasing to stagnation pressure at the upstream face 182. The local pressure in the vicinity of the valve edge 120 is thus significantly increased. This increased pressure at the downstream part of the lean surface 123 of the valve 120 reduces the likelihood of gas seepage from the rich passage 160 through to the lean passage 150.

Figure 3:
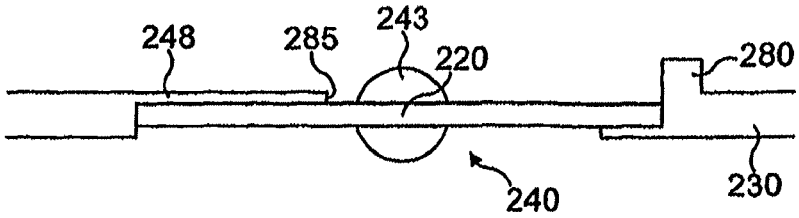
FIG. 3 is a similar view showing a further possible feature.
Figure 4:
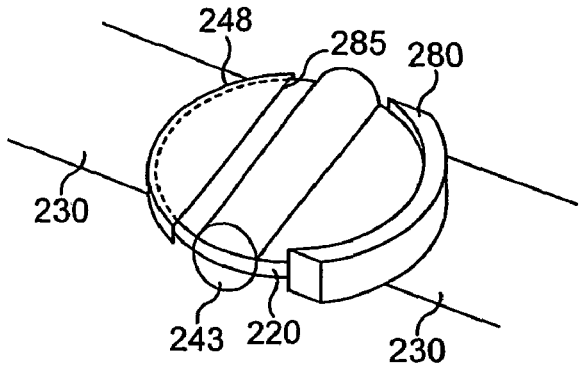
FIG. 4 is a schematic view showing the upstream seating ledge of FIG. 3.

FIGS. 3 and 4 show a further feature which may be incorporated into the carburettor. The geometry of the valve 220 and partition wall 230 and the protrusion 280 are substantially the same as in FIG. 2. In this embodiment, however, the seating ledge 248 extends fully across the aperture 240 up to the pivot rod 243. Hence, as shown in FIG. 4, the seating ledge 248 has a semi-circular outer edge to accommodate the perimeter of the valve 120 and a linear inner edge 285 adjacent the pivot rod 243. The gap between the inner edge 285 and the pivot rod 243 is thus minimised.

Figure 5:
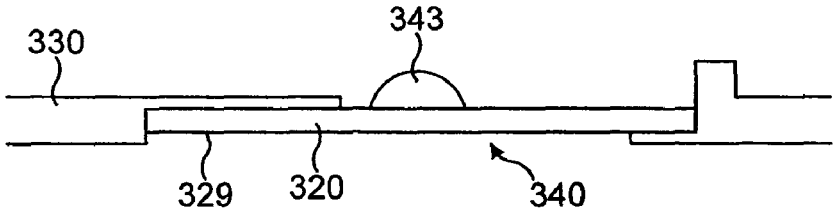
FIG. 5 is a schematic view showing a further possible feature.

FIG. 5 shows a further possibility in which the lower half of the pivot rod 343 is removed. The pivot rod 343 is in effect flattened or of semi-cylindrical shape so that it lies flush with the rich surface 329 of the valve 320. The pivot rod 343 is securely affixed to the valve 320 using a countersunk screw head (not shown) or other appropriate fastening means that will not disturb the rich surface 323.

In use, when the valve 320 fully closes the aperture 340, the flow over the upstream portion of the partition wall 330 will continue to flow attached to the rich surface 329 of the valve 320. Thus, the high pressure associated with stagnation of the flow at the upstream side of the pivot rod 343 lower semi-cylindrical portion is avoided.

Figure 9:
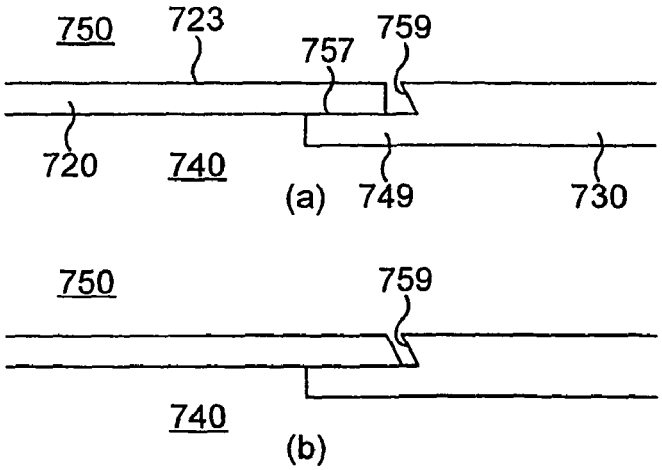

The construction of FIG. 9 is intended for use in the carburettor where there is no protrusion 180, 280 present. The upstream face 759 of the seating ledge 749 is inclined as shown in FIG. 9*a*, such that a portion thereof that is nearest the lean passage 750 extends further into the aperture 740 than does a portion of the face 759 that is adjacent the seating surface 757. In a preferred embodiment the circumferential edge of the valve 720 is also bevelled to approximately the same degree of inclination or a lesser degree of inclination as that of the upstream face 759 as shown in FIG. 9*b*. In each case, the clearance gap between the valve 720 and the upstream face 759 of the partition wall 730 must be sufficient that the valve 720 is able to rotate in and out of register with the seating ledge 749 without infringing the upstream face 759.

Figure 6:
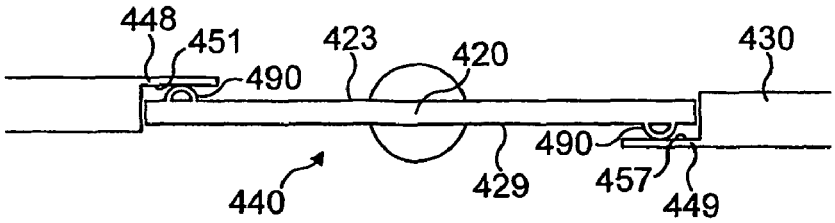
FIG. 6 is a view showing yet a further possible feature.

FIG. 6 shows yet a further feature which can be used if it is considered desirable to include a mechanical seal between the valve 420 and the seating ledges 448/449. The geometry of the valve 420 and of the partition wall 430 is identical to that of the prior art carburettor of FIG. 1 (that of WO99/58829). However in this case, each of the lean surface 423 and the rich surface 429 of the valve 420 has a resilient semi-circular protrusion 490 disposed thereon adjacent the perimeter of the valve. The resilient protrusions together extend around the valve perimeter. In this case, the resilient protrusion comprises an inverted U-shaped loop portion manufactured from rubber or suitable plastic or other resilient material. The loop 490 is affixed to the valve 420 such that, in use, as the valve approaches the second position in which the aperture 440 is closed, the resilient loop 490 compresses to form a mechanical seal between the valve 420 and the seating ledge 448 or 449 respectively. The resilient protrusion 490 can be on the valve surfaces 429 and 423 or the seating surfaces 451 and 457.

Figure 7:
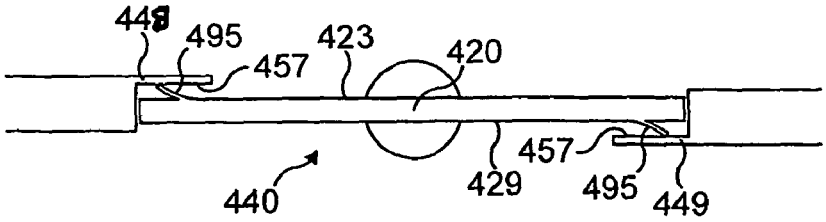
FIGS. 7 and 8 are further views of modifications of the feature shown in FIG. 6.

In a modified construction shown in FIG. 7, the resilient protrusion 495 comprises a semi-circular tongue disposed on the rich surface 429 and the lean surface 423 of the valve 420. The tongue is inclined at a shallow angle to the respective valve surface 423/429 when the valve 420 is in the first position. The tongue 495 protrudes radially outwards from the valve surface. In use, as the valve approaches the second position in which the aperture 440 is closed, the resilient tongue 490 deforms toward the valve surface 423/429 to form a mechanical seal between the valve 420 and the seating ledge 448 or 449 respectively.

A suitable material for the resilient protrusion 490/495 might be a plastic that is resistant to the high temperature and chemicals with which it may come into contact whilst in use in the carburettor. The resilient protrusion 490/495 may be moulded, e.g. integrally with the valve 420 or the seating surfaces 451 and 457 or it may be affixed thereto.

Figure 8:
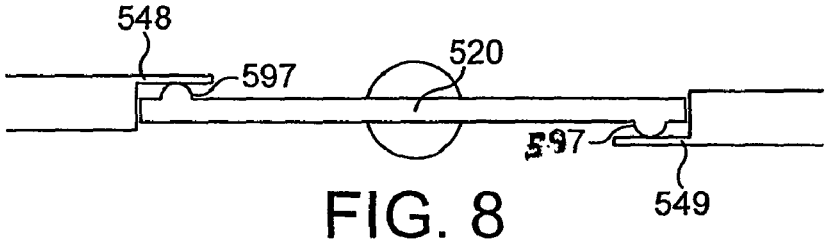

FIG. 8 shows a further modified construction. The valve 520 is contoured to provide a lip around the periphery of the upstream part of the lean surface 523 and the downstream part of the rich surface 529. The lip 597 comprises a substantially non-resilient protrusion of semi-circular cross-section protruding from the otherwise flat valve surface 523/529. The lip 597 provides a mechanical contact seal between the valve 520 and the seating ledge 548/549 when the valve is in use in the second position.

The valve 420 may be stamped out or moulded from a suitable material as stated above. The valve 420 or the seating surfaces 451 and 457 may be spray coated with a suitable rubber or elastomer to provide the seal between them. The protrusion may be located on only the lean surface 423 or only the rich surface 429 of the valve 420.

It is noted that for each of the embodiments described herein, the relevant geometrical feature of the invention need not extend around the whole upstream half or the whole downstream half of the seating ledge or valve to which it is applied. Each feature may extend only partially around the upstream half or downstream half of the seating ledge/valve as appropriate.

Although the various figures show only a single feature of the carburettor, it will be evident to the skilled man that two or more of the features described may be utilised in conjunction with one another on the same carburettor where this is appropriate, to minimise the chance of gas seepage from the rich passage into the lean passage when the valve fully closes the aperture but that they may also be used individually.

The invention claimed is:

1. A carburettor including a flow duct comprising rich and lean flow passages in parallel, through which, in use, air flows in a flow direction and which are separated by a substantially planar partition, at least one fuel jet communicating with the rich passage, the partition including an aperture towards which the fuel jet is directed, and a substantially planar butterfly valve being received in the aperture so as to be pivotable between a first position, in which the flow duct is substantially closed and the aperture is substantially open, and a second position, in which the flow duct is substantially open and the aperture is substantially closed, the upstream half of the aperture being defined by an upstream semi-annular seating ledge affording an upstream seating surface which is engaged by one of the surfaces of the butterfly valve when it is in the second position and a first end surface which extends between the upstream seating surface and that surface of the partition which is directed toward the lean passage, the downstream half of the aperture being defined by a downstream semi-annular seating ledge affording a downstream seating surface which is engaged by the other surface of the butterfly valve when it is in the second position and a second end surface, which extends between the downstream seating surface and that surface of the partition which is directed towards the rich passage, characterized in that a protrusion is disposed adjacent the second end surface on the surface of the partition which is directed towards the lean passage, the protrusion having an upstream face that is positioned such that, in use in the second position of the valve, a stagnation pressure is generated thereon.

2. A carburettor as claimed in claim 1 in which the valve is pivotally mounted on a pivot rod and the protrusion protrudes into the lean passage by a distance at least as great as that by which the pivot rod protrudes into the lean passage.

3. A carburettor as claimed in claim 1 in which the protrusion comprises a first surface extending transversely to the partition and a second surface adjacent the first surface and inclined thereto the first and second surfaces meeting at an edge which is substantially rounded.

4. A carburettor as claimed in claim 3 in which the first surface is inclined at an angle to the plane of the valve such that a portion of it which protrudes furthest into the lean passage extends further into the aperture than does a portion of the surface that is nearer to the partition.

5. A carburettor as claimed in claim 1 in which the upstream seating surface is dimensioned to engage substantially the entire upstream surface of the valve directed towards the lean passage, when the valve is in the second position.

6. A carburettor as claimed in claim 1 in which the valve is mounted on a pivot rod for rotation between the first and second positions, the pivot rod being constructed such that it protrudes into the lean passage only.

7. A carburettor as claimed in claim 1 in which the partition includes a semi-circular upstream face directed towards the aperture at the downstream portion thereof, which is spaced from the side surface of the valve, when in the second position, whereby, in use, a stagnation pressure is generated on the upstream face.

8. A carburettor as claimed in claim 1 in which the partition wall and valve are arranged such that, in use, in the second position, the surface of the valve directed towards the rich passage and the surface of the partition upstream of the valve that is directed towards the rich passage are substantially aligned with one another.

9. A carburettor as claimed in claim 1 in which the valve includes a resilient protrusion on the upstream surface thereof directed towards the lean passage and/or on the downstream surface thereof directed towards the rich passage, the protrusion being arranged for resilient sealing engagement with the respective seating surface.

10. A carburettor as claimed in claim 1 in which the valve upstream surface directed towards the lean passage and/or downstream surface directed towards the rich passage is contoured to incorporate a protrusion, which, in use in the second position of the valve, provides a contact seal between the valve and the upstream or downstream seating ledge, respectively.

* * * * *